US007028014B1

(12) United States Patent
Naclerio

(10) Patent No.: US 7,028,014 B1
(45) Date of Patent: Apr. 11, 2006

(54) TAMPER RESISTANT POSTAL SECURITY DEVICE WITH LONG BATTERY LIFE

(75) Inventor: Edward J. Naclerio, Madison, CT (US)

(73) Assignee: ASCOM Hasler Mailing Systems, Shelton, CT (US)

( * ) Notice: Subject to any disclaimer, the term of this patent is extended or adjusted under 35 U.S.C. 154(b) by 0 days.

(21) Appl. No.: 09/646,489

(22) PCT Filed: Mar. 18, 1999

(86) PCT No.: PCT/US99/05891

§ 371 (c)(1),
(2), (4) Date: Nov. 2, 2000

(87) PCT Pub. No.: WO99/48055

PCT Pub. Date: Sep. 23, 1999

Related U.S. Application Data

(60) Provisional application No. 60/078,489, filed on Mar. 18, 1998.

(51) Int. Cl.
*G06F 17/00* (2006.01)

(52) U.S. Cl. ..... 705/401

(58) Field of Classification Search ..... 713/194, 713/200, 300; 705/401, 402, 403, 405, 406, 705/410, 60, 61
See application file for complete search history.

(56) References Cited

U.S. PATENT DOCUMENTS 4,484,307 A * 11/1984 Quatse et al. ..... 705/410
4,575,621 A 3/1986 Dreifus ..... 235/380
4,882,752 A 11/1989 Lindman et al. ..... 380/25
5,097,253 A 3/1992 Eschbach et al. ..... 340/545
5,249,227 A 9/1993 Bergum et al. ..... 380/4
5,363,447 A * 11/1994 Rager et al. ..... 380/273

(Continued)

FOREIGN PATENT DOCUMENTS

EP 0376487 A2 * 7/1990

(Continued)

OTHER PUBLICATIONS

Unknown author, Crypto iButton Validated as a Postal Security Device—U.S. Postal Service Now Accepts Computer-Made Stamps as Postage, Aug. 9, 1999, Dallas Semiconductor Corporation—WebScan: Press Release, 2p.*

*Primary Examiner*—Thomas A. Dixon
(74) *Attorney, Agent, or Firm*—Perman & Green, LLP

(57) ABSTRACT

In accordance with the invention, a postal security device (PSD) (10) contains a non-volatile memory (13) which does not depend on battery power such as an EEPROM (13), and contains a nonvolatile memory (14, 16) which does depend on battery power, such as a static RAM. The PSD (10) also contains an encryption engine (12, 14, 22). An encryption key is developed and is stored in the static RAM (14), which is sized to be only large enough to contain the encryption key. A large body of data, too large to fit in the static RAM, is encrypted by means of the encryption engine (12, 14, 22) and with reference to the encryption key, and is stored in the EEPROM (13). This body of data typically includes cryptographic keys and sensitive bit-images. When the PSD is powered, a large RAM (typically a dynamic RAM) (16) is available to receive the large body of data, decrypted using the encryption key. A tamper switch (17) cuts power to both RAMs (14, 16) in the event of tampering.

18 Claims, 1 Drawing Sheet

U.S. PATENT DOCUMENTS

| | | | | |
|---|---|---|---|---|
| 5,515,540 | A * | 5/1996 | Grider et al. | 713/194 |
| 5,668,973 | A | 9/1997 | Stutz et al. | 711/152 |
| 5,712,542 | A | 1/1998 | Stutz et al. | 318/66 |
| 5,771,348 | A * | 6/1998 | Kubatzki et al. | 713/200 |
| 5,832,207 | A * | 11/1998 | Little et al. | 713/200 |
| 6,591,251 | B1 * | 7/2003 | Leon et al. | 705/401 |

FOREIGN PATENT DOCUMENTS

| | | |
|---|---|---|
| WO | WO 97/46389 | 12/1997 |
| WO | WO 98/08325 | 2/1998 |
| WO | WO 98/13790 | 4/1998 |
| WO | WO 98/20461 A2 * | 5/1998 |

* cited by examiner

TAMPER RESISTANT POSTAL SECURITY DEVICE WITH LONG BATTERY LIFE

The invention relates generally to postage meters (franking machines), and relates particularly to systems in which postage value is stored in a postal security device (PSD) so as to be protected against undetected tampering. The application claims priority from U.S. application No. 60/078,489, filed Mar. 18, 1998, which application is incorporated herein by reference to the extent permitted by the designated and elected States hereto.

BACKGROUND

In recent years it has been proposed to print postal indicia by means of conventional nonsecure printers such as laser printers, ink-jet printers, and thermal transfer printers. Such printers are termed "nonsecure" because the printer itself is not in a secure housing and because the communications channel linking the printer to other apparatus is nonsecure. Under such a proposal, the question naturally arises what would prevent a user from printing the same postal indicium repeatedly, thereby printing postal indicia for which no money has been paid to the post office. The proposed anti-fraud measure is to store information within the indicia which would permit detecting fraud. The indicium would include not only human-readable text such as a date and a postage amount, but would also include machine-readable information, for example by means of a two-dimensional bar code. The machine-readable information would be cryptographically signed, and would include within it some information intended to make fraud more difficult. The information would typically include an identification of the postage meter license (granted by the meter manufacturer or by the postal authorities, depending on the country), an indication of the number of mail pieces franked, the postage amount, a postal security device identifier about which more will be said later, the date and time, and a zip code or post code of the mail piece addressee.

The typical apparatus for printing such "encrypted indicia" postage includes what is called a postal security device or PSD. The PSD has a secure housing, and within the secure housing are the accounting registers as well as a cryptographic engine. The engine permits cryptographic authentication and signing for communication with an external device such as the computer of the meter manufacturer or of the post of ice. The engine also permits creation of postal indicia which contain specified information and which are cryptographically signed. The PSD may well be physically small as compared to traditional postage meters. The PSD may be the size of a PCMCIA card or the size of a smart card.

Within the PSD the memory must be protected against inadvertent damage due to malfunction of the processor of the PSD, for example as set forth in U.S. Pat. No. 5,668,973, Protection system for critical memory information owned by the same assignee as the assignee of the present application. The PSD must handle power failure in a graceful fashion, for example as set forth in U.S. Pat. No. 5,712,542, Postage meter with improved handling of power failure, also owned by the same assignee as the assignee of the present application.

To reduce smudging, the printer may preferably be that described in PCT publication no. 97-46389, Printing apparatus, also owned by the same assignee as the assignee of the present application. While it has been proposed that the PSD contain a real-time clock which is keeping time continuously, desirably this requirement may be avoided as described in PCT publication no. 98-08325, Printing postage with cryptographic clocking security, also owned by the same assignee as the assignee of the present application. PSDs can form part of a network with multiple printers as described in PCT publication no. 98-13790, Proof of postage digital franking, also owned by the same assignee as the assignee of the present application.

The postal authorities face the question how the PSD can be protected from tampering. For example, the entire system of PSDs depends on the use of cryptographic keys. The keys are used for authenticating communications between the PSD and the manufacturer's system or the postal authority's system. Such communications are used to set up and maintain the PSDs, and are used to refill or "reset" the PSDs to reflect the ability to print more postage. The keys are also used to cryptographically "sign" information printed in the postal indicia. If the cryptographic keys were compromised, a user might be able to defraud the post office or the PSD manufacturer or both.

Many approaches have been proposed for protection of such cryptographic keys from compromise. The usual approach is to place the cryptographic keys in a RAM (random access memory) of a type which keeps its contents only so long as the RAM receives power from a battery. The secure housing of the PSD is designed to include a tamper switch, so that if the secure housing is tampered with, the switch opens. The switch interrupts power to the RAM (and, in particular, interrupts battery power to the RAM) and its contents are lost. In this way the information in the RAM (for example, the cryptographic keys) is protected from tampering. Another proposed approach is to employ commercial memory chips (such as the Dallas Semiconductor DS1283 and Benchmarq bq3283) offer a pin on the package which will clear the memory based on a predetermined input voltage level. The tamper switch is set up to apply the predetermined voltage upon detection of tampering.

Many approaches have also been proposed for detection of the tampering. In EP 820 041, for example, it is suggested that the secure housing of an old-style mechanical or electromechanical postage meter be set up to contain an air pressure that is distinctively higher than or lower than normal atmospheric pressure. If the secure housing is violated, the pressure within the secure housing changes to match the ambient pressure. A sensor within the housing detects the pressure change and thus the violation. The sensor disables further function of the postage meter.

The approach of cutting power to a volatile memory such as the RAM discussed above has a drawback in that during periods of power-down, the RAM depends on an internal battery to avoid loss of the information in the RAM. Depending on the requirements of the postal authority, and on design decisions made by the PSD manufacturer, the quantity of data requiring protection may be quite large. The data to be protected may include cryptographic keys used for PSD configuration, keys used for remote resetting (refilling), keys used for signing postal indicia, and keys used for the management of the other keys. In addition it may be desired to protect the bit-images used to generate the human-readable portion of the printed indicia. A RAM big enough to hold all of these important items of data will also draw a non-negligible current from the internal battery. This may lead to a limited and commercially unacceptable battery life.

It would thus be desirable to have a PSD design which protects the many important items of data stored within, and yet which does not draw very much battery power and so permits a commercially acceptable battery life.

SUMMARY OF THE INVENTION

In accordance with the invention, a postal security device (PSD) contains a nonvolatile memory which does not depend on battery power, such as an EEPROM, and contains a nonvolatile memory which does depend on battery power, such as a static RAM. The PSD also contains an encryption engine. An encryption key is developed and is stored in the static RAM, which is sized to be only large enough to contain the encryption key. A large body of data, too large to fit in the static RAM, is encrypted by means of the encryption engine and with reference to the encryption key, and is stored in the EEPROM. This body of data typically includes cryptographic keys and sensitive bit-images. When the PSD is powered, a large RAM (typically a dynamic RAM) is available to receive the large body of data, decrypted using the encryption key. A tamper switch cuts power to both RAMs in the event of tampering. In this way, the battery power required to maintain the PSD during power-off periods is minimal, and yet the large body of data will be inaccessible in the event of tampering.

DESCRIPTION OF THE DRAWING

The invention will be described with respect to a drawing, of which.

DETAILED DESCRIPTION

Figure 1:
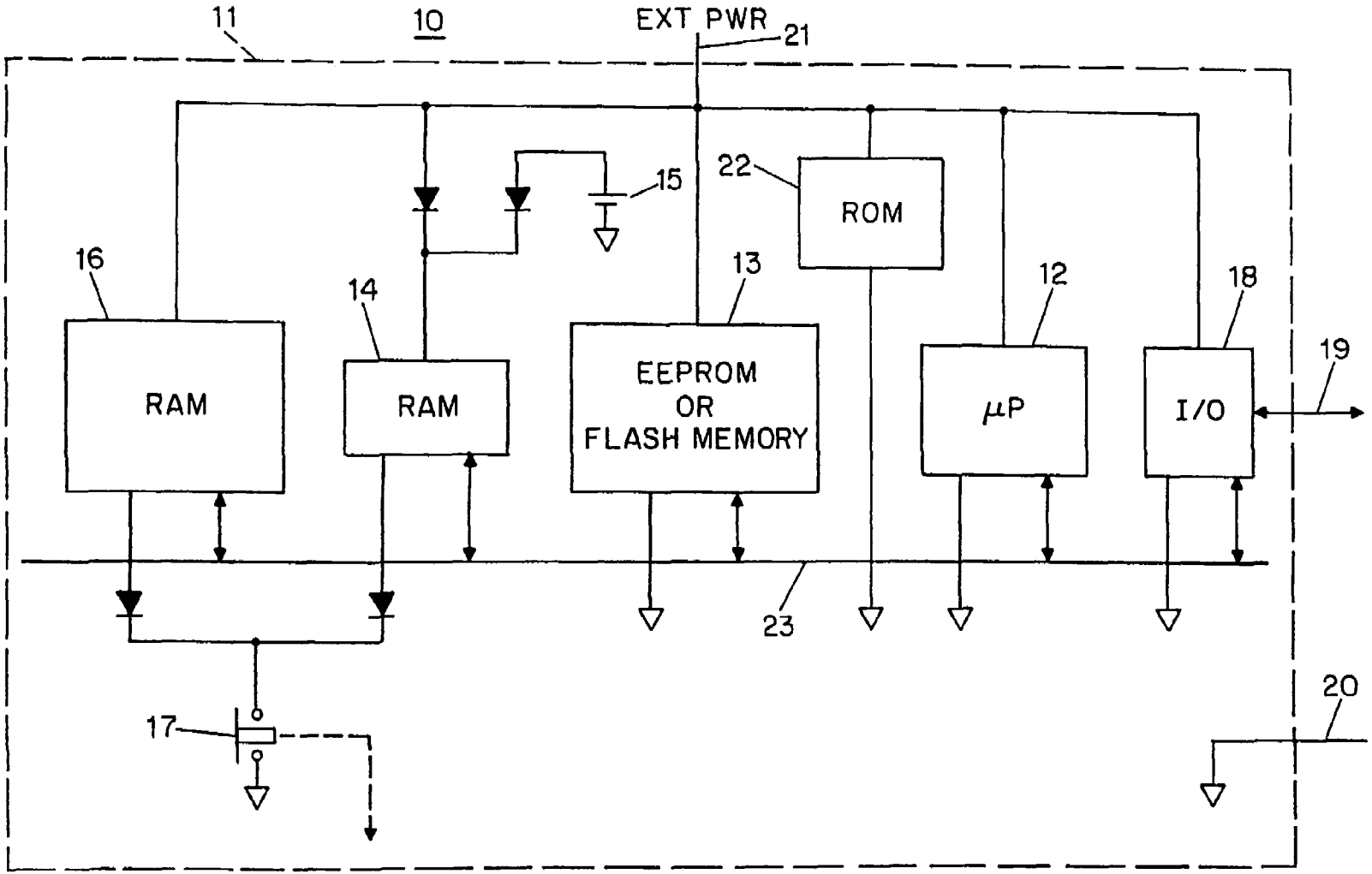
FIG. 1 is a schematic functional block diagram of a system according to the invention.

FIG. 1 shows a postal security device (PSD) in accordance with the invention. The PSD has a microprocessor 12 which communicates on a bus 23 with an input/output (I/O) device 18, a memory which does not require battery backup 13 which may be for example an EEPROM or flash memory, a relatively small RAM 14, a ROM 22, and a larger RAM 16. The I/O device 18 communicates with external apparatus by means of communications channel 19 which may be a serial asynchronous data line. External power 21 and ground 20 are also defined. The larger RAM 16, and most other active components receive external power. The smaller RAM 14 is additionally able to receive power from a backup battery 15, preferably a lithium cell with a very long (e.g. ten year) life. A tamper switch 17 is provided which, when triggered, can cut power to both the small RAM 14 and the large RAM 16.

A large body of data is assumed to require protection from a tampering user. The EEPROM is selected to be large enough to hold this body of data after it has been encrypted. When power is applied and the system is stable, the body of data (or selected portions thereof) is decrypted and transferred to RAM 16. This decryption is performed by the microprocessor 12 executing a decryption routine stored in the ROM 22, and the decryption is done with respect to a decryption key in the RAM 14. Alternatively the decryption may be performed by an optional engine omitted for clarity in FIG. 1. The decrypted data in RAM 16 are used as needed for the ordinary functions of the PSD, which include communicating via the communications channel 19 with a user computer, with a manufacturer's system, or with a postal authority system, and can include generating postal indicia which are to be printed by means of a printer.

When external power 21 is cut off, or when the PSD undergoes a normal power-down routine, the information in the RAM 16 is lost. In contrast, the information in the RAM 14 is preserved even when external power 21 is lost, because of battery 15.

During normal operation the body of data that requires protection from a tampering user (or some portion of it) may be located "in the clear", that is, unencrypted, in the RAM 16. In the event that this data has changed, it may be necessary to encrypt the data and to store it again in the memory 13. This encryption is performed by the processor 12 executing encryption software in the ROM 22, or may optionally be performed by an encryption engine omitted for clarity in FIG. 1.

The power-down condition for the PSD 10 assumes that no power is present at line 21. In that event, the only powered device is RAM 14. RAM 14 was purposefully selected to be large enough to hold the encryption key but not much larger, and in any event is smaller than the large body of data that is understood to require protection from a tampering user. Because of the limited size of the RAM 14, it does not draw as much current from the battery 15 as would be drawn by a larger RAM such as RAM 16. Thus, the battery life is optimized, especially as compared with the shorter battery life that would result if the large body of data were all in battery-backed-up RAM.

Tampering may happen during a time when external power 21 is present. At a minimum, the tamper switch should cut power to the RAM 14. (Or, alternatively, the tamper switch should apply to RAM 14 the predetermined voltage that clears the RAM.) Preferably the tamper switch will also cut power to the RAM 16 (or clear the RAM 16), for the reason that some of the body of sensitive data may be present "in the clear" in the RAM 16, and should not fall into the hands of the tampering user. Alternatively the tamper switch might trigger an interrupt in the processor 12 which would cause the processor 12 to clear the sensitive portions of the RAM 16.

Tampering may also happen during a time when external power 21 is absent. In such a case, the RAM 16 is already, by definition, empty, as it is unpowered. The tamper switch causes the RAM 14 to be cleared. If the tampering user extracts the contents of the memory 13, this is of little significance, because the contents are useless unless decrypted with the assistance of the key that is no longer present in the RAM 14. If the PSD 10 is powered up again after the tampering, the decryption routine will not work because the key of RAM 14 is gone. In addition, desirably the processor 12, under program control, will note the fact that RAM 14 is empty and will immediately attempt to send a message via communications channel 19 to the manufacturer or to the postal authority.

Those skilled in the art will readily appreciate that design considerations may prompt the use of electrical components in addition to or instead of those shown in FIG. 1, none of which depart in any way from the invention. For example, dedicated cryptographic chips may be employed which take some of the computational burden from the microprocessor. As another example, the particular way in which the tamper switch cuts power to the RAM may be varied, and the particular type of tamper switch may be selected among several types, all without departing in any way from the invention. Those skilled in the art will indeed have no difficulty devising obvious variations and improvements to the invention, all of which are intended to be encompassed by the claims that follow.

The invention claimed is:

1. A method for use with a postal security device comprising a secure housing, and within the secure housing a body of data having a size, said postal security device also having within the secure housing means for generating print data for printing of postage indicia, said generating of said print data relying in part on the body of data, said postal security device also having within the secure housing a first memory sized to accommodate the body of data, said first memory of a type not requiring electrical power to maintain the contents thereof, the postal security device also having within the secure housing a second memory not large enough to accommodate the body of data, said second memory of a type that requires electric power to maintain its contents, said postal security device also comprising a battery powering the second memory and a tamper switch mechanically coupled with the secure housing so that upon tampering with the secure housing the second memory is disconnected from the battery, said postal security device further comprising an encryption key stored within said second memory, said postal security device further comprising a cryptographic engine; the method comprising the steps of:

storing the encryption key within the second memory;

encrypting the body of data by the cryptographic engine with respect to the encryption key;

storing the encrypted body of data in the first memory;

upon power-up of the postal security device decrypting the encrypted body of data with the cryptographic engine with respect to the encryption key;

temporarily storing the decrypted body of data in a third memory, wherein upon power down of the postal security device the decrypted body of data is lost; in the event of tampering with the postal security device, removing power from the second memory and the third memory resulting in a loss of the encryption key and the decrypted body of data; and requiring battery power for the second memory in order to minimize a need for back-up battery power in the postal security device, the second memory being limited in data storage capacity size in order to minimize battery power consumption when the second memory relies on back-up battery power.

2. A method for use with a postal security device comprising a secure housing, and within the secure housing a body of data having a size, said postal security device also having within the secure housing means for generating print data for printing of postage indicia, said generating of said print data relying in part on the body of data, said postal security device also having within the secure housing a first memory sized to accommodate the body of data, said first memory of a type not requiring electrical power to maintain the contents thereof, the postal security device also having within the secure housing a second memory not large enough to accommodate the body of data, said second memory of a type that requires electric power to maintain its contents, said postal security device also comprising a battery powering the second memory and a tamper switch mechanically coupled with the secure housing so that upon tampering with the secure housing the second memory is disconnected from the battery, said postal security device further comprising an encryption key stored within said second memory, said postal security device further comprising a cryptographic engine; the method comprising the steps of:

storing the encryption key within the second memory;

encrypting the body of data by the cryptographic engine with respect to the encryption key;

storing the encrypted body of data in the first memory;

upon power-up of the postal security device decrypting the encrypted body of data with the cryptographic engine with respect to the encryption key;

temporarily storing the decrypted body of data in a third memory, wherein upon power down of the postal security device the decrypted body of data is lost;

in the event of tampering with the postal security device, removing power from the second memory and the third memory resulting in a loss of the encryption key and the decrypted body of data; and limiting a size of data stored in the second memory to the encryption key in order to maximize a life of the battery powering the second memory.

3. The method of claim 2 further comprising, upon power-up of the postal security device, detecting a presence of the encryption key, and if not present, transmitting a message to an administrator of the postal security device indicating a breach of the postal security device.

4. The method of claim 2 further comprising determining that the data in the second memory is lost and automatically notifying a postal authority.

5. A postal security device having improved battery power consumption during power-off periods comprising;

a first memory device for storing encrypted data, the first memory device being connected to a main power source and not connected to a back-up battery power source;

a second memory device having a memory storage capacity sufficient to store only an encryption key, the encryption key being used to decrypt the encrypted data stored in the first memory device when the postal security device is powered on, the second memory being connected to both the main power source and the back-up battery power source, the second memory device having a data storage capacity size limited to the encryption key to minimize battery power consumption when the second memory relies on back-up battery power, only the second memory having a battery source in order to minimize a need for back-up battery power;

an encryption engine adapted to decrypt the encrypted data using the encryption key during power on; and a third memory for temporarily storing the decrypted data, the third memory being connected only to the main power source;

wherein when the main power source is interrupted, the decrypted data in the third memory is lost while the second memory retains the encryption key, and since only the second memory requires back-up battery power, battery power consumption of the postal security device is reduced.

6. The postal security device of claim 5 further comprising an anti-tamper device adapted to interrupt power to the second memory device and the third memory device, wherein the body of decrypted data is lost and the encryption key is not available.

7. The postal security device of claim 5 further comprising a postal indicia generator adapted to receive the decrypted body of data from the postal security device over a communications channel and print a postal indicia relying in part of the decrypted body of data.

8. A postal security device comprising:

a secure housing, and within the secure housing:

a first nonvolatile memory device not having a backup battery power source and adapted to store an encrypted body of data when power is applied to the postal security device and when power is not applied to the postal security device;

a second nonvolatile memory device having a backup battery power source and having a storage capacity only large enough to store an encryption key, the second non volatile memory having a limited data size tied to the encryption key to maximize a life of the back-up battery power source;

an encryption engine adapted to encrypt a body of data with reference to the encryption key in order to form the encrypted data stored in the first nonvolatile memory;

a third memory device not having a backup battery and adapted to temporarily store a body of decrypted data while the postal security device is powered on, the body of decrypted data being transferred to the third memory device from the encryption engine when the postal security device is initially powered on, the encryption engine decrypting the decrypted data stored in the second memory device with respect to the encryption key when the postal security device is powered on; and wherein when the postal security device powers down, the body of decrypted data temporarily stored in the third memory device is lost and battery power required to maintain the postal security device is minimized.

9. The postal security device of claim 8 further comprising a means for generating print data for the printing of postal indicia, the generating of the print data relying in part on the decrypted body of data.

10. The postal security device of claim 4 further comprising an anti-tamper device adapted to interrupt power to the second memory device and the third memory device when the secure housing of the postal security device is tampered with, wherein the body of decrypted data is lost and the encryption key is not available.

11. The postal security device of claim 4 wherein the body of data includes cryptographic keys and sensitive bit-images.

12. The postal security device of claim 4 further comprising a detection device adapted to detect that the second non-volatile memory device is no longer storing the encryption key and send a message via a communications channel to an administrator of the postal security device for action.

13. A method of improving back-up battery power consumption in a postal security device comprising:

storing a body of encrypted data in a first memory device that does not have a back-up battery power source, the encrypted data being encrypted by an encryption engine with respect to an encryption key;

storing the encryption key in a second memory device in the postal security device, only the second memory device having a back-up battery power source and having a maximum storage capacity limited to a size of the encryption key and limiting data storage capacity size of the second memory in order to minimize battery power consumption when the second memory relies on back-up battery power, wherein a need for back-up battery power in the postal security device is minimized;

powering up the postal security device and automatically decrypting the encrypted data with respect to the encryption key stored in the second memory device;

temporarily storing the decrypted data in a third memory device not having a back-up power source, wherein if power to the postal security device is interrupted, the decrypted data is lost and only the encryption key stored in the second memory device having the battery back-up is maintained; and causing the decrypted data in the third memory device and the encryption key to be lost if the postal security device is tampered with.

14. The method of claim 13 further comprising generating an electrical signal when the postal security device is tampered with that causes the second memory device and the third memory device to automatically clear their respective memories.

15. The method of claim 13 further comprising, if the postal security device is tampered with, interrupting main electrical power to the second memory and the third memory and interrupting back-up electrical power to the second memory, wherein the interruption of main and back-up electrical power causes the second memory and the third memory to be cleared.

16. The method of claim 13 further comprising minimizing an amount of back-up battery power consumed by the postal security device when the postal security device is powered down by requiring back-up power only for the second memory.

17. The method of claim 13 further comprising storing only the encryption key and the encrypted body of data when no power is supplied to the postal security device and only the back-up power is supplied to the second memory device.

18. The method of claim 13 further comprising generating a postal indicia relying in part on the decrypted body of data and transmitting the postal indicia over a communications channel to a printer for printing the postal indicia.

* * * * *